United States Patent [19]

Brueggemann et al.

[11] Patent Number: 4,907,138

[45] Date of Patent: Mar. 6, 1990

[54] LONG FIELD LAMP

[75] Inventors: Juergen Brueggemann, Graunreut; Martin Hell, Trostberg, both of Fed. Rep. of Germany

[73] Assignee: Siemens Aktiengesellschaft, Berlin and Munich, Fed. Rep. of Germany

[21] Appl. No.: 217,432

[22] Filed: Jul. 11, 1988

[30] Foreign Application Priority Data

Aug. 14, 1987 [DE] Fed. Rep. of Germany ..... 3727220

[51] Int. Cl.[4] ..... F21S 3/00

[52] U.S. Cl. ..... 362/147; 362/217; 362/368; 362/260

[58] Field of Search ..... 362/217, 260, 562, 368, 362/147, 404, 145, 457, 458

[56] References Cited

U.S. PATENT DOCUMENTS

| | | | |
|---|---|---|---|
| 2,309,182 | 1/1943 | Giles etal. | 362/217 |
| 2,316,404 | 4/1943 | Carter | 362/217 |
| 2,324,683 | 7/1943 | Despard | 362/217 |
| 3,014,680 | 12/1961 | Steinbach | 362/260 |
| 3,599,911 | 8/1971 | Monte | 248/50 |
| 4,208,702 | 6/1980 | Wotoweic | 362/260 |
| 4,238,815 | 12/1980 | Price | 362/260 |

FOREIGN PATENT DOCUMENTS

| | | |
|---|---|---|
| 7227870.7 | 7/1972 | Fed. Rep. of Germany . |
| 2529219 | 1/1975 | Fed. Rep. of Germany . |
| 2918443 | 8/1979 | Fed. Rep. of Germany . |
| 2317591 | 7/1975 | France . |
| 428939 | 4/1965 | Switzerland . |

*Primary Examiner*—Ira S. Lazarus
*Assistant Examiner*—D. M. Cox
*Attorney, Agent, or Firm*—Hill, Van Santen, Steadman & Simpson

[57] ABSTRACT

For the uniform illumination of rooms that have no special demands in terms of freedom of glare and reflective behavior, simply fashioned long field lamps are provided wherein a fluorescent tube is located in freely radiating fashion under a housing containing electrical components. The channel-like housing has a U-shaped cross-section and is mounted on an installation track fastened to a ceiling or wall and is provided with a cover on both face sides. In order to shorten installation time, the long field lamp has a simple structural design. A cover track representing the actual installation track is designed in common with end parts having plug-in ledges. These ledges plug onto narrow sides of the cover track to form a ceiling installation frame into which the housing is introduced from below and to which the housing is latchably held.

16 Claims, 2 Drawing Sheets

LONG FIELD LAMP

BACKGROUND OF THE INVENTION

The present invention relates to a long field lamp having a channel like housing containing a fluorescent lamp ballast and mount holders including electrical wiring. A U-shaped cross-section of the housing is inwardly beaded in a hook-edged fashion at free ends of its legs. The mount holders, fastened at a floor of the housing at opposite sides, project through the housing and have mounts for accepting a fluorescent tube located outside the housing. The housing, at its upper side is terminated with a cover track and, at its narrow sides, is terminated with end parts adapted thereto.

Long field lamps of this type are known, for example, by the references DE 29 18 443 Al and DE-GM 72 27 870. They are used for indoor lighting of rooms that are to be illuminated uniformly and are usually installed directly on ceilings or walls. Light bands of any length can be created with them by a series arrangement.

For a simple installation on a ceiling or a wall, profiled installation tracks can be provided, as the reference DE 29 18 443 Al discloses, to which the long field lamp with its housing is secured from below. This double fastening, first, of the installation track to the wall or ceiling, and second of the lamp to its housing, causes a considerable amount of installation time particularly when many such lamps are to be installed in series.

SUMMARY OF THE INVENTION

An object of the invention is to provide a long field lamp of the type initially described that has optimally simple structure and allows a very rapid and simple installation, regardless of whether the long field lamp is to be installed as an individual lamp or in a light band composite.

The long field lamp of the present invention has a channel-like housing which contains a fluorescent lamp ballast and mount holders including electrical wiring. A U-shaped cross-section of the housing is inwardly formed in a hooked edge-shaped fashion. The mount holders are fastened to a floor of the housing on opposite sides and project with their mounts through the housing. The mounts accept a fluorescent tube located outside the housing. The housing is terminated at its upper side with a cover track and is terminated at its narrow sides with end parts adapted thereto.

The end parts at their upper side and adjacent the narrow sides of the cover track have plug-in ledges directed parallel to the cover track. The plug-in ledges of the end parts are plugged onto the narrow sides of the cover track to form a ceiling installation frame for the housing which can be placed therein from below and which is latchably held by the end parts. The ceiling installation frame in a region of the plug-in ledge of the end part accepting one end of the cover track, respectively, has a screw opening for ceiling installation of the ceiling installation frame.

A feature of the invention is that the fastening of the housing to an installation track previously secured to the ceiling or the wall, can be a simple manipulation if instead of an installation track, a cover in the form of a track is used. By slipping end parts on its narrow sides, the cover is coupled into a ceiling installation frame, into which the housing can be latchably placed from below.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
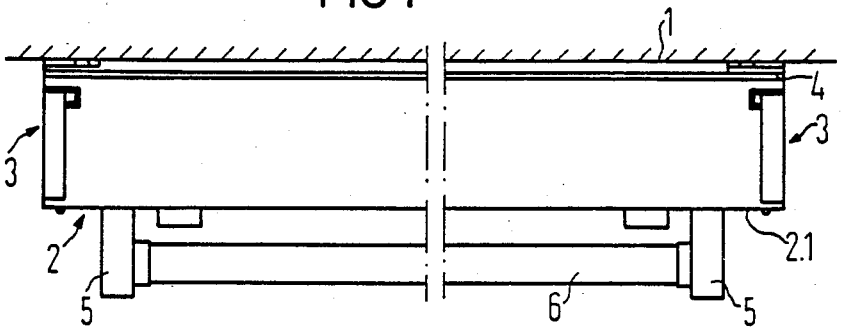
FIG. 1 is a side view of a long field lamp of the present invention installed on a ceiling.

A long field lamp installed on a ceiling 1 is composed of a channel-like housing 2 having a U-shaped cross-section, and two end parts 3 covering the housing 2 at its narrow sides. The end parts 3 for holding the housing 2 in a locked fashion, and a cover track 4 that has the end parts 3 slipped onto its narrow sides, form a ceiling installation frame for the housing 2. The housing 2 contains the fluorescent lamp ballast (not illustrated), as well as the lamp holder 5 including electrical wiring (also not shown). The fluorescent tube 6 is retained in a freely radiating fashion under the housing 2 by mounts of the mount holders 5 which project with their mounts through the floor 2.1 of the housing 2.

Figure 2:
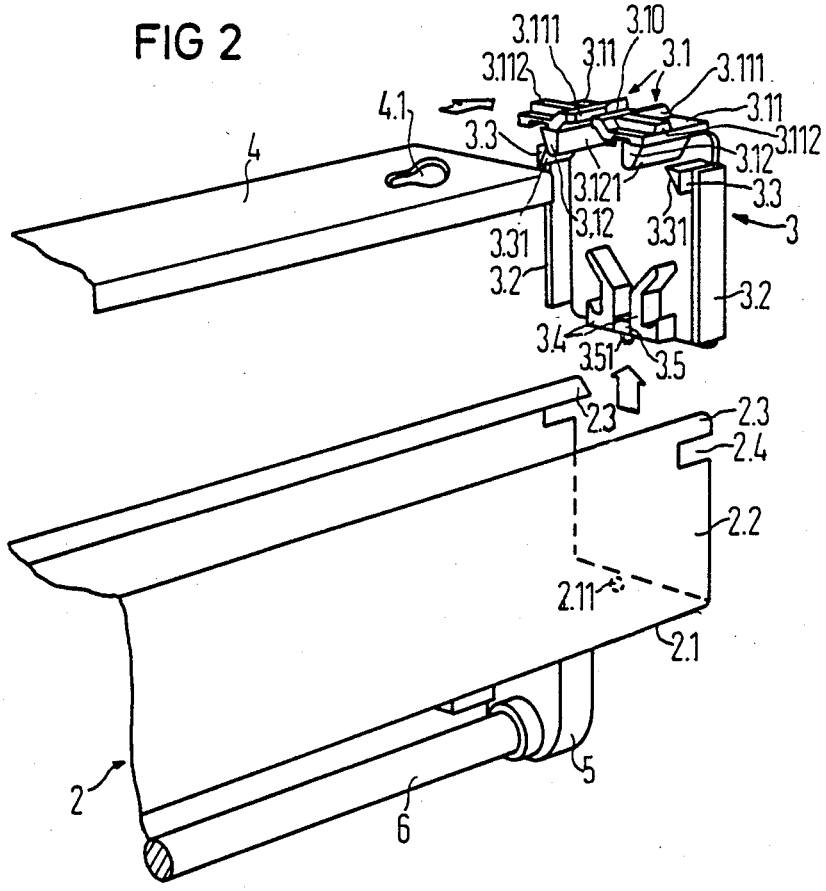
FIG. 2 is a partial perspective view of a right end of the long field lamp according to FIG. 1 in an exploded illustration.

A partial view of one end of the FIG. 1 long field lamp shown in FIG. 2 in an exploded illustration, reveals the most significant construction features of the end parts 3 that hold the housing 2 in this cover installation frame. Each end part 3, on its upper side at the side of the cover track, has a plug-in ledge/strip 3.1 directed parallel to the cover track 4. This plug-in ledge 3.1 is divided in two halves by a key-hole like shaping 3.2 (also see FIG. 3). Each half of the plug-in ledge 3.1 is symmetrically arranged relative to the shaping 3.2 and is composed of a retaining plate 3.11 and a supporting bar 3.12 provided under the retaining plate 3.11 at a distance corresponding to the thickness of the cover track 4 extends approximately across the length of the retaining plate 3.11. The cover track 4 is pushed until it detents into the slot formed between the supporting bars 3.12 and the retaining plates 3.11. In this end region inserted in the plug-in ledge 3.1, the cover track 4 has a hole in the form of keyhole 4.1 which essentially coincides with the keyhole-like shaping 3.10 between the two halves of the plug-in ledge 3.1 and serves for the fastening of the ceiling installation frame by means of a screw on one side respectively.

During the installation, first the fastening screws are almost fully screwed into the ceiling or wall, then the ceiling installation frame is hooked into the screws and pushed in the direction of the narrow side of the keyhole 4.1 and finally the fastening screws are tightened. Due to the arrangement of the fastening holes for the ceiling installation frame in the area of the plug-in ledges 3.1, the plug-type connection of the cover track 4 in the plug-in ledge 3.1 of the end part 3 is secured at the same time.

At their upper side the retaining plates 3.11 are provided with spacer webs, in order to level irregularities across the length of the long field lamp. Here, a first spacer web 3.111 extending in a longitudinal direction of the housing 2, is located at the edge of the retaining plate 3.11 at the side of the keyhole-like shaping 3.10 and is adapted to this shaping at its outer edge. A second spacer web 3.112 is provided perpendicularly to the first spacer web 3.111, in the center of the retaining plate 3.11 and extends from the first spacer web 3.111 to the opposite edge of the retaining plate 3.11.

At the side of the housing 2, the end parts 3 have side cheeks 3.2 that overlap the face edge of side walls 2.2 of the housing 2 when the housing 2 is coupled to the ceiling installation frame. At the upper end on the inside of the side cheeks 3.2 at the same level with the left edge of the supporting bars 3.12 of the plug-in ledge 3.1, catch arms 3.3 are located and extend, with their free ends, beyond the width of the side cheeks 3.2. The catch arms 3.3 have a wedge-shaped cross-section with a leading surface 3.31 directed obliquely down. The U-shaped cross-section of the housing 2 is formed into a hook edge 2.3 at the free ends of its two legs. Closely below this hook edge 2.3, catch openings 2.4 for mating with the catch arms 3.3 are provided in the area of the face edges of the side walls 2.2 and lock in the catch arms 3.3 in the direction of the arrow, when inserting the housing 2 in the ceiling installation frame from below.

Figure 3:
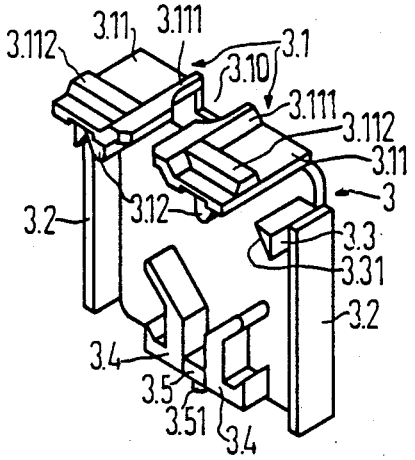
FIG. 3 is a further, perspective view of an end part of the long field lamp according to FIG. 1.
Figure 4:
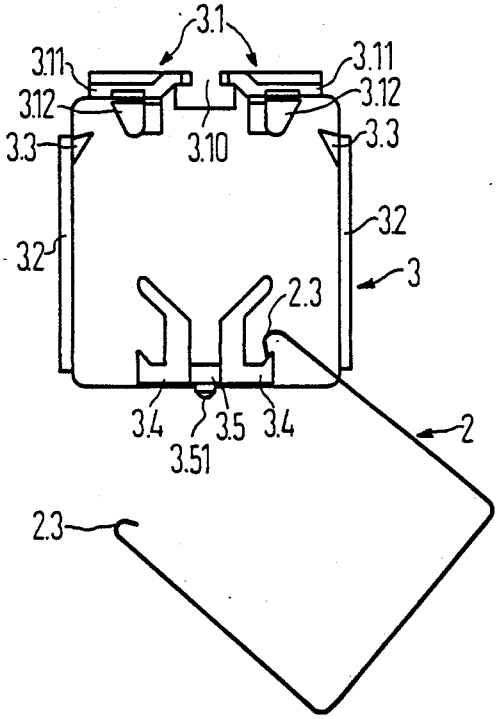
FIG. 4 is a more detailed end view of the end part showing the disconnecting of the housing from the end parts.

As also shown in FIGS. 2 through 4, the end parts 3 at the side of the housing 2, are provided with a suspending means 3.4 under each supporting bar 3.12 of the plug-in ledges respectively, namely at the bottom edge of the end part 3. The suspending means 3.4 have a hook profile that is open towards the proximal side cheek 3.2 and is similar to a clothes hook. As shown in FIG. 4, the suspending means 3.4 forms a one-side suspension for the housing at the hook edge 2.3 on its side wall 2.2 by engaging between side cheek 3.2 and suspension means 3.4. This suspension simplifies in an advantageous manner the electrical connections between the interior wiring and the long field lamp that are to be made during installation. This suspension allows the housing 2 to be preliminarily held in the ceiling installation frame in a position in which the space under the cover track 4, as well as the interior of the housing 2, remain freely accessible for this installation work.

As FIG. 2 in particular shows, a projection 3.5 with a centering pin 3.51 directed perpendicularly downward is provided at the bottom side of the end parts 3 at the side of the housing 2 between the suspension means 3.4. This centering pin 3.51 engages a corresponding opening 2.11 in the floor of the housing, when the housing 2 is coupled to the ceiling installation frame, and provides further support.

The end pieces 3 can be formed in plastic with a molding or transfer moulding method.

The suggested long field lamp can be used in many different ways for the uniform illumination of rooms, and also for the creation of light bands, since any series arrangement can be installed.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

what is claimed is:

1. A long field lamp having a channel-like housing containing a fluorescent lamp ballast and mount holders including electrical wiring, a U-shaped cross-section of the housing being inwardly formed in a hooked edge-shaped fashion, whereby the mount holders fastened to a floor of the housing on opposite sides project with their mounts through the housing for accepting a fluorescent tube located outside the housing, and whereby the housing is terminated at its upper side with a cover track and is terminated at its narrow sides with end parts adapted thereto, comprising:

the end parts at their upper side and adjacent narrow sides of the cover track having plug-in ledges directed parallel to the cover track, the plug-in ledges of the end parts plugged onto the narrow sides of the cover track to form a ceiling installation frame for the housing which can be placed therein from below and which is latchably held by the end parts, the ceiling installation frame, in a region of the plug-in ledge of the end part accepting one end of the cover track respectively, having a screw opening for ceiling installation of the ceiling installation frame, each of the cover track and the respective end part which form the ceiling installation frame having an oblong hole and a keyhole-like shape, respectively, which are in adjacent alignment in the formed ceiling installation frame, the oblong hole and keyhole-like shape being the screw opening.

2. A long field lamp having a channel-like housing containing a fluorescent lamp ballast and mount holders including electrical wiring, a U-shaped cross-section of the housing being inwardly formed in a hooked edge-shaped fashion, whereby the mount holders fastened to a floor of the housing on opposite sides project with their mounts through the housing for accepting a fluorescent tube located outside the housing, and whereby the housing is terminated at its upper side with a cover track and is terminated at its narrow sides with end parts adapted thereto, comprising:

the end parts at their upper side and adjacent narrow sides of the cover track having plug-in ledges directed parallel to the cover track, the plug-in ledges of the end parts plugged onto the narrow sides of the cover track to form a ceiling installation frame for the housing which can be placed therein from below and which is latchably held by the end parts, the ceiling installation frame, in a region of the plug-in ledge of the end part accepting one end of the cover track respectively, having a screw opening for ceiling installation of the ceiling installation frame; and the plug-in ledge of the end part being divided into two halves by a centrally arranged keyhole-like shaping, and each half being composed of a retaining plate with spacer webs located on an upper side of the retaining plate and a supporting bar provided under the retaining plate at a distance corresponding to the thickness of the cover track and extending approximately across the length of the retaining plate.

3. The long field lamp according to claim 2, wherein a first spacer web extending in a longitudinal direction of the housing and a second spacer web extending perpendicularly thereto are provided on the upper side of the retaining plate, of which the first spacer web forms the edge of the retaining plate on the side of the keyhole-like shaping and is adapted, on this side, to the keyhole structure, and of which the second spacer web is centrally adjacent to the first spacer web, and extends across the width of the retaining plate to the edge of the plate located on the opposite side.

4. The long field lamp according to claim 3, wherein each end part on the side of the housing is provided with side cheeks which, when the housing is coupled to the ceiling installation frame, cover side walls of the housing at their edges, and wherein on an inside at an upper end of the side cheeks at the same level with a lower end of the supporting bar of the plug-in ledge, one catch arm respectively, extends beyond the width of a side cheek on the side of the housing, this catch arm having a wedge-shaped cross-section and a leading surface directed obliquely down, and wherein the side walls of the housing, at the face ends below the hooked edge has catch openings corresponding to the catch arms, in which the catch arms engage as soon as the side walls of the housing are lifted with their hook edges beyond the oblique leading surfaces of the catch arms until detent occurs against the bottom side of the retaining plates, when placing the housing in the ceiling installation frame.

5. The long field lamp according to claim 4, wherein the supporting bars on the side of the catch arms have stop faces for the hook edges of the side walls, the stop faces being directed obliquely down, supporting the engaging of the housing when placing the housing in the ceiling installation frame.

6. The long field lamp according to claim 5, wherein the end parts, at the side of the housing, under a supporting bar of the plug-in ledges at the lower edge of the end part, have two suspension means respectively, the suspension means having a hook profile open towards the proximal side cheek for suspending the housing from the hook edge by its side wall engaging between the side cheek and suspension means.

7. The long field lamp according to claim 6, wherein the end parts at the side of the housing at the lower edge have a projection centrally arranged between the suspension means and having a centering pin directed vertically down, the projection engaging an opening in the floor of the housing when the housing is placed in the ceiling installation frame.

8. The long field lamp according to claim 2, wherein the end parts are plastic molded parts or plastic transfer molding parts.

9. A long field lamp having a channel-like housing containing a fluorescent lamp ballast and mount holders including electrical wiring, a U-shaped cross-section of the housing being inwardly formed in a hooked edge-shaped fashion, whereby the mount holders fastened to a floor of the housing and project with mounts through the housing for accepting a fluorescent tube located outside the housing, and whereby the housing is terminated at its upper side with a cover track and is terminated at its narrow sides with end parts adapted thereto, each of said end parts comprising:

plug-in ledges on an upper side of the end part and positioned parallel to the cover track for plugging onto narrow sides of the cover track to form a ceiling installation frame for the housing, the housing engaging the ceiling installation frame from below and being latchably held by the end parts;

the ceiling installation frame having a means for providing a ceiling installation of the ceiling installation frame in a region of the plug-in ledge of the end part; and the plug-in ledge of the end part being divided into two halves by a centrally arranged keyhole-like shaping, and each half being composed of a retaining plate and a supporting bar provided under the retaining plate at a distance corresponding to the thickness of the cover track and extending approximately across the length of the retaining plate.

10. The long field lamp according to claim 9 wherein said means for providing a ceiling installation is a screw opening.

11. The long field lamp according to claim 9, wherein a first spacer web extending in a longitudinal direction of the housing and a second spacer web extending perpendicularly thereto are provided on the upper side of the retaining plate, of which the first spacer web forms the edge of the retaining plate on the side of the keyhole-like shaping and is adapted, on this side, to the keyhole structure, and of which the second spacer web is centrally adjacent to the first spacer web, and extends across the width of the retaining plate to the edge of the plate located on the opposite sides.

12. The long field lamp according to claim 11, wherein each end part on the side of the housing is provided with side cheeks which, when the housing is coupled to the ceiling installation frame, cover side walls of the housing at their edges, and wherein on an inside at an upper end of the side cheeks at the same level with a lower end of the supporting bar of the plug-in ledge, one catch arm respectively, extends beyond the width of a side cheek on the side of the housing, this catch arm having a wedge-shaped cross-section and a leading surface directed obliquely down, and wherein the side walls of the housing, at the face ends below the hooked edge has catch openings corresponding to the catch arms, in which the catch arms engage as soon as the side walls of the housing are lifted with their hook edges beyond the oblique leading surfaces of the catch arms until detent occurs against the bottom side of the retaining plates, when placing the housing in the ceiling installation frame.

13. The long field lamp according to claim 12, wherein the supporting bars on the side of the catch arms have stop faces for the hook edges of the side walls, the stop faces being directed obliquely down, supporting the engaging of the housing when placing the housing in the ceiling installation frame.

14. The long field lamp according to claim 13, wherein the end parts, at the side of the housing, under a supporting bar of the plug-in ledges at the lower edge of the end part, have two suspension means respectively, the suspension means respectively, the suspension means having a hook profile open towards the proximal side cheek for suspending the housing from the hook edge by its side wall engaging between the side cheek and suspension means.

15. The long field lamp according to claim 14, wherein the end parts at the side of the housing at the lower edge have a projection centrally arranged between the suspension means and having a centering pin directed vertically down, the projection engaging an opening in the form of the housing when the housing is placed in the ceiling installation frame.

16. The long field lamp according to claim 9, wherein the end parts are plastic molded parts or plastic transfer molding parts.

* * * * *